US005491501A

United States Patent [19]

Dietl et al.

[11] Patent Number: 5,491,501

[45] Date of Patent: Feb. 13, 1996

[54] MEDIUM FOR INK DELIVERY SYSTEMS

[75] Inventors: Steven J. Dietl, Ontario; David P. Breemes, Palmyra, both of N.Y.

[73] Assignee: Xerox Corporation, Stamford, Conn.

[21] Appl. No.: 257,979

[22] Filed: Jun. 10, 1994

Related U.S. Application Data

[63] Continuation-in-part of Ser. No. 885,704, May 19, 1992.

[51] Int. Cl.[6] ..... B41J 2/175

[52] U.S. Cl. ..... 347/86; 347/93

[58] Field of Search ..... 347/86, 87, 85, 347/93; 210/172, 251, 259

[56] References Cited

U.S. PATENT DOCUMENTS

| | | | |
|---|---|---|---|
| 4,095,237 | 6/1978 | Amberntsson et al. | 346/140 |
| 4,368,478 | 1/1983 | Koto | 347/86 |
| 4,463,359 | 7/1984 | Ayata et al. | 346/1.1 |
| 4,771,295 | 9/1988 | Baker et al. | 346/1.1 |
| 4,929,969 | 5/1990 | Morris | 346/140 |
| 4,931,811 | 6/1990 | Cowger et al. | 347/87 |
| 5,182,581 | 1/1993 | Kashimura et al. | 347/93 |
| 5,289,212 | 2/1994 | Carlotta | 347/87 |
| 5,420,625 | 5/1995 | Dietl et al. | 347/85 |

OTHER PUBLICATIONS

"Method of Operation of Ink Jet Printer" by Dale R. Ims et al., *Xerox Disclosure Journal,* vol. 16, No. 4 Jul./Aug. 1991, p. 233.

*Primary Examiner*—Benjamin R. Fuller
*Assistant Examiner*—Kevin Saunders
*Attorney, Agent, or Firm*—Oliff & Berridge

[57] ABSTRACT

A system for supplying liquid ink to a thermal ink-jet printing apparatus comprises a housing defining a chamber having a ventilation port and an outlet port. The chamber retains a quantity of liquid ink. An ink delivery medium is disposed across the outlet port, providing a capillary force greater than that of the medium. The ink delivery medium is a high density, fine pore fully open cell polyester polyurethane, preferably, ULTRA FINE. A filter is attached to the ink delivery medium.

14 Claims, 9 Drawing Sheets

| FILTER FOAM PROPERTY ↓ | OPTIMIZATION TARGET | ULTRA-FINE POLYESTER 4.5MM 11μ PET KX215 WEB | MELAMINE WITH 11 MICRON FILTER | MELAMINE WITH 9 MICRON FILTER |
|---|---|---|---|---|
| INK COMPATABILITY | EXCELLENT | EXCELLENT | POOR | POOR |
| FILTRATION | | | | |
| FILTRATION -PARTICLE COUNT IN CARTRIDGE | 0 FIBER | 0 FIBERS DRIED INK | >200 | 30 |
| INCOMING ORIGINAL CLEANLINESS | 0 FIBERS | EXCELLENT | POOR | POOR |
| MECHANICAL | | | | |
| PUNCHABILITY | PER DRAWING | OK | OK | OK |
| COMPRESSION SET | <5% | NONE | POOR | POOR |
| EXPANSION WHEN WET | <5% | OK | OK | OK |
| INK DELIVERY | | | | |
| -IMPEDANCE ($H_2O$/CC/MIN) | MINIMIZE | .15 | .21 | .9 |
| -START PRESS. | -1 | -2 | -2 | -2 |
| -END PRESS. | -6 | -7.5 | -6 | -7 |
| OUTPUT PORT | FULL/NO FOAMING | 1/2 FULL NO FOAMING | <1/2 FULL FOAMING | <1/2 FULL FOAMING |
| PRINTED PAGES | MAXIMUM | 1261 | —— | 1234 |
| STEADY STATE IMPEDANCE | | | | |
| -$H_2O$ | MINIMIZE | .18 | .18 | 1.6 |
| -P2A | MINIMIZE | .39 | .45 | 2.28 |
| CHEMICAL | | | | |
| DYE ABSORPTION | NONE | NONE | NONE | NONE |
| SURFACTANT | NONE | NONE | NONE | NONE |

FIG.4

| PERFORMANCE PARAMETER | FILTER FOAM CONFIGURATION: MELAMINE WITH 9 MICRON FILTER | ULTRAFINE WITH 11 MICRON FILTER: PILOT WAIT TIME | PROD WAIT TIME | COMBINED TOTAL |
|---|---|---|---|---|
| SAMPLE SIZE | 17 | 20 | 19 | 39 |
| START WEIGHT (GRAMS) | | | | |
| MEAN | 150.75 | 150.97 | 150.75 | 150.84 |
| STD DEV | 0.51 | 0.35 | 0.51 | 0.08 |
| t VALUE | -0.639 | -1.38 | XXX | XXX |
| t CRITICAL (95% 2 TAIL) | 2.00 | 2.10 | XXX | XXX |
| MEANS DIFF? | NO | NO | XXX | XXX |
| END WEIGHT (GRAMS) | | | | |
| MEAN | 91.28 | 89.76 | 89.74 | 89.75 |
| STD DEV | 0.76 | 0.95 | 0.88 | 0.90 |
| t VALUE | 6.09 | 0.00 | XXX | XXX |
| t CRITICAL (95% 2 TAIL) | 2.00 | 2.10 | XXX | XXX |
| MEANS DIFF? | YES | NO | XXX | XXX |
| NO. OF PAGES | | | | |
| MEAN ACTUAL | 1234 | 1262 | 1260 | 1261 |
| MEAN ADJ (1.0204x) | 1259 | 1288 | 1286 | 1287 |
| STD DEV | 34 | 44 | 33 | 39 |
| t VALUE | -2.59 | 0.00 | XXX | XXX |
| t CRITICAL (95% 2 TAIL) | 2.00 | 2.10 | XXX | XXX |
| MEANS DIFF? | YES | NO | XXX | XXX |
| PAGES DURING OUT OF INK | | | | |
| MEAN | 1.0 | 1.62 | 3.18 | 2.29 |
| STD DEV | 0.0 | 1.96 | 4.46 | 3.07 |
| t VALUE | XXX | --- | --- | 3.103 |
| t CRITICAL | XXX | --- | --- | 2.00 |
| MEANS DIFF? | XXX | --- | --- | YES |
| INK WEIGHT LOSS (GRAMS) | | | | |
| MEAN | 59.40 | 61.17 | 60.95 | 61.06 |
| STD DEV | 0.90 | 0.94 | 0.54 | 0.77 |
| t VALUE | -7.05 | -0.80 | XXX | XXX |
| t CRITICAL (95% 2 TAIL) | 2.00 | 2.10 | XXX | XXX |
| MEANS DIFF? | YES | NO | XXX | XXX |

FIG.9

MEDIUM FOR INK DELIVERY SYSTEMS

This application is a continuation-in-part application of U.S. patent application Ser. No. 07/885,704, filed May 19, 1992, the disclosure of which is incorporated herein by reference.

BACKGROUND OF THE INVENTION

1. Field of the Invention

This invention relates to ink delivery systems. More particularly, this invention relates to a medium for ink delivery and filtration.

2. Description of Related Art

Existing ink delivery systems fail to provide and maintain a high quality print with good optical density, in large part, due to the break up and deterioration of existing foam and felt ink mediums used. The dislodged fibers, particles and debris are identified as a large cause of ink channel blocking. Ink channel blockage can result in ink drop out, missing jets, exploding jets and other jetting problems. Although wire mesh or filters have been used between the ink medium and the nozzle to filter particles, these filters suffer from inefficient filtration and blockage because particles, debris or fibers which are difficult to filter out bypass the filter. Also, the filters have a tendency to clog with particles, debris or fibers from the foam or felt that do not bypass the filter. The surface of the filter is difficult to clean once particles, debris or fibers have collected thereon. The clogging causes slow ink refill and air ingestion problems in the printhead resulting in slow print speed and poor ink jet print quality.

Melamine foam is a frequently used foam in ink delivery systems, as disclosed in U.S. patent application Ser. No. 07/885,704. However, although melamine foam has the advantage of low impedance and high efficiency, melamine foam can be dirty. Pieces of the foam may break off during use, and melamine foam may produce melamine dust. Therefore, use of melamine foam in ink delivery systems requires the use of filters. The melamine dust is difficult to filter out, is difficult to clean off a filter surface, and has a tendency to bypass and clog the ink channel, thereby causing the problems associated with ink blockage as discussed above. Accordingly, melamine foam must be precleaned prior to use. In addition, a finer filter, for example, a 9 micron filter is necessary in practical use to adequately filter the particles associated with melamine foam. Since melamine foam requires a finer filter, the impedance increases.

Reticulated foam is also unclean or dirty. During processing, the cells are broken by explosive reaction, and free material exists within the foam. Accordingly, reticulated foams must also be precleaned to filter out the free material. Precleaning, however, does not filter out all the free material and during use further breakage occurs generating more particles and debris. As a result, the problems discussed above relating to ink blockage occur.

Foams presently used in ink delivery systems, other than melamine foam, are formulated by a foaming process using surfactants. An expensive cleaning process is required to remove non-water soluble surfactants from the foams so that the foams can be used in ink delivery systems. Presently, a freon cleaning wash is used to clean foams. However, this cleaning process, and the residuals remaining after the cleaning process, must be disposed of properly to avoid negative environmental impacts.

SUMMARY OF THE INVENTION

An ink delivery and filtration medium is needed that has a low impedance, is clean (has substantially no loose particles, debris or fibers in the foam as originally produced or throughout the use in an ink delivery system), has a low compression set and is substantially free of surfactants. More particularly, a medium is needed for use in a scavenger element discussed in greater detail herein.

Accordingly, it is a primary object of the invention to provide an ink delivery and filtration medium that is clean, free from surfactants and has a low impedance while having a high efficiency.

Another object of the invention is to provide an ink delivery and filtration medium that has a controllable density and is dimensionally stable even when ink is added.

Another object of the invention is to provide an ink delivery and filtration medium that does not require surfactant precleaning.

Another object of the invention is to eliminate expansion and bowing of the ink delivery and filtration medium.

Another object of the invention is to provide an ink delivery and filtration medium that avoids air leaks.

Another object of the invention is to provide an ink delivery and filtration medium that is compatible with ink.

Another object of the invention is to provide an ink delivery and filtration medium that has substantially no loose particles or debris.

Another object of the invention is to provide an ink medium that has good clickability or punchability.

Another object of the invention is to provide an ink medium with nearly zero compression set.

Another object of the invention is to provide an improved scavenger element.

The foregoing objects are obtained by the invention, which includes an ink delivery and filtration medium for ink delivery systems. The ink delivery and filtration medium comprises a foam that is a high density, fine pore, fully open cell polyester polyurethane. Preferably, the raw material for the foam is available from Foamex of Eddystone, Pa. under the tradename "ULTRA FINE" and a felted version of the foam is available from Illbruck, USA of Minneapolis, Minn. In one embodiment of the invention, the ink medium is used in a scavenger element.

Other objects, advantages and salient features of the invention will become apparent from the following detailed description, which, taken in conjunction with the drawings, discloses preferred embodiments of the invention.

BRIEF DESCRIPTION OF THE DRAWINGS

Referring now to the drawings which form a part of the disclosure:

FIG. 4 is a chart comparing the properties of filter foams, including the medium in accordance with the invention;

FIG. 9 is a chart of test data resulting from a life cycle test of ink cartridges using different ink delivery and filtration mediums.

DETAILED DESCRIPTION OF PREFERRED EMBODIMENTS

For purposes of illustrating the invention, the following description incorporates a medium in accordance with the invention into a scavenger element as disclosed in copending U.S. patent application Ser. No. 07/885,704, which is incorporated herein by reference. However, it is within the scope of the invention to provide the medium in accordance with the invention in any applicable ink delivery system.

Figure 3:
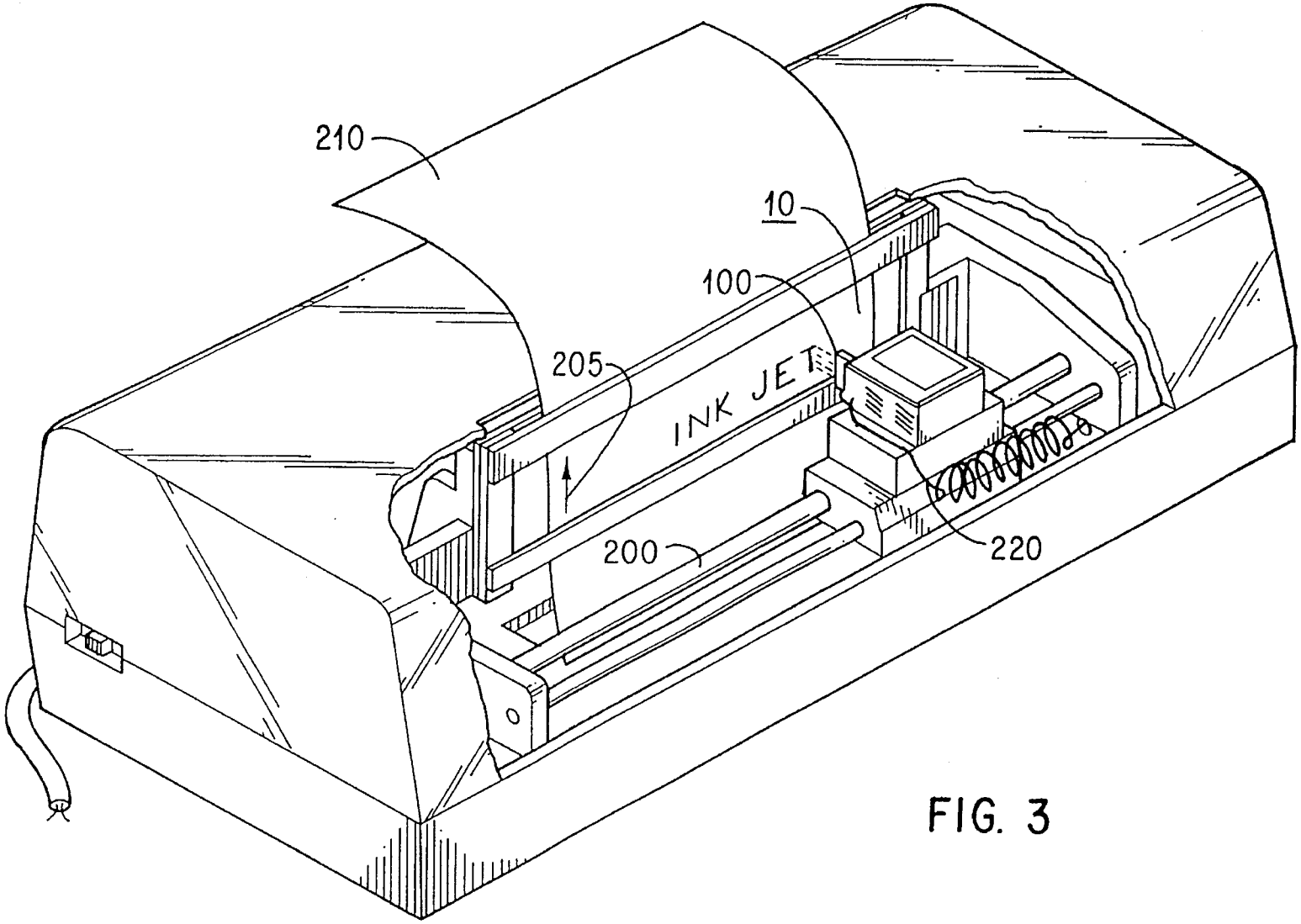
FIG. 3 is an perspective view of a thermal ink jet printing apparatus.

FIG. 3 is a general elevational view of a type of thermal ink-jet printer in which the printhead and ink supply are combined in a single package, for example, a cartridge 10. The main portion of cartridge 10 is the ink supply, with another portion forming the actual printhead 100. In this embodiment of the invention, cartridge 10 is placed in a thermal ink jet printing apparatus in which the cartridge 10 is caused to move along carriage 200 in such a way that printhead 100, moving relative to sheet 210, may print characters on the sheet 210 as the cartridge 10 moves across the sheet, somewhat in the manner of a typewriter. In the example illustrated, printhead 100 is of such a dimension that each path of cartridge 10 along sheet 210 enables printhead 100 to print out a single line of text. Although, it is generally not necessary for the text lines to conform to the swaths of the copy cartridge 10. With each swath of cartridge 10, sheet 210 may be indexed (by means not shown) in the direction of the arrow 205 so that any number of passes of printhead 100 may be employed to print text or images on the sheet 210. Cartridge 10 also includes means, generally shown as 220, by which digital image data may be entered into the various heating elements 110 of printhead 100 to print out the desired image. These means 220 may include, for example, plug means which are incorporated in the cartridge 10 and which accept a bus or cable from the data-processing portion of the apparatus, and permit an operative connection to the heating elements in the printhead 100.

Figure 1:
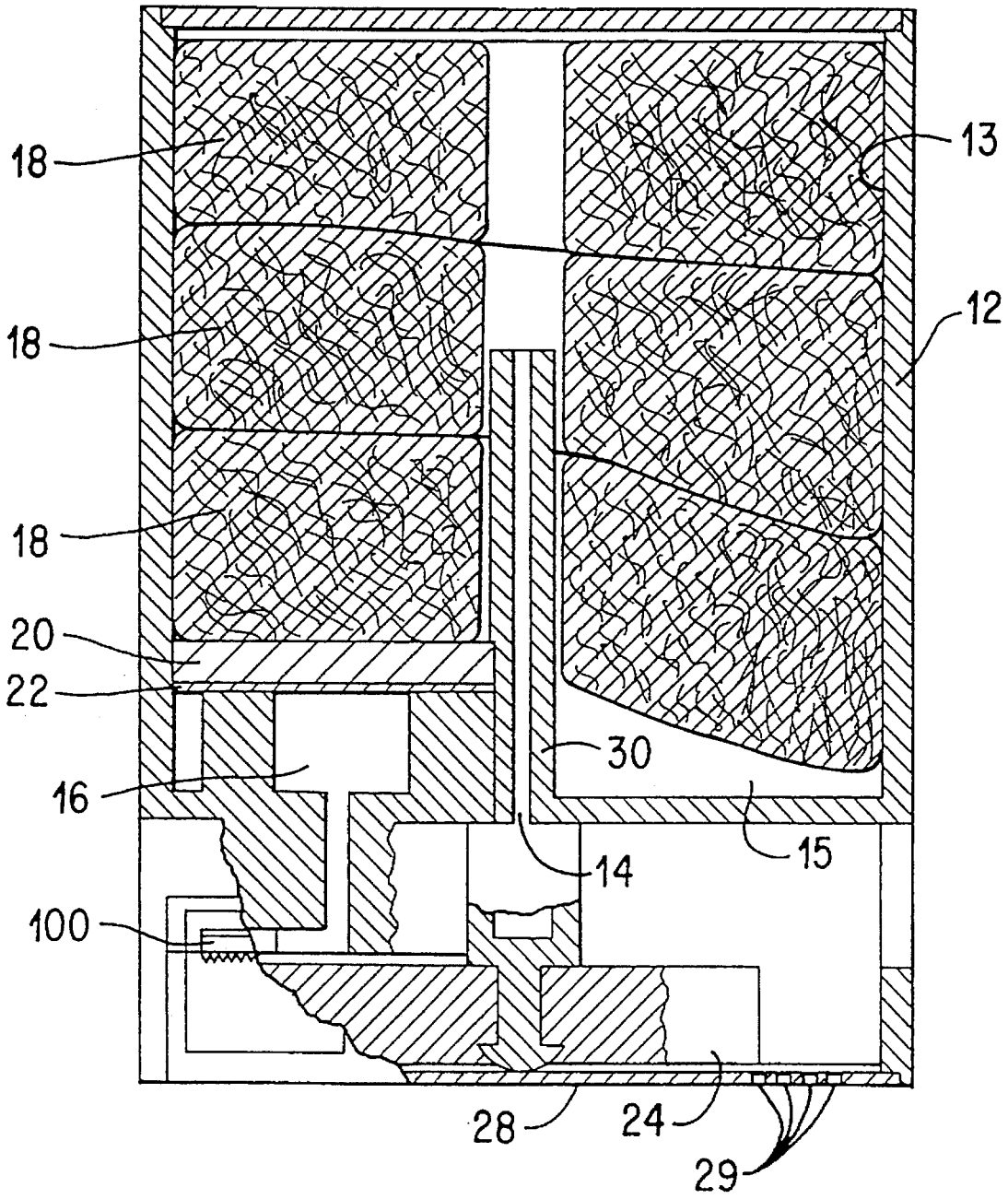
FIG. 1 is a sectional, elevational view of a cartridge incorporating the present invention.

FIG. 1 is a sectional, elevational view of cartridge 10. The cartridge 10 has a main portion in the form of housing 12. Housing 12 is typically made of a lightweight but durable plastic. Housing 12 defines a chamber 13 for the storage of liquid ink, and further has defined therein a ventilation port 14, which is open to the atmosphere, and output port 16. At the end of the output port 16 (as shown at the broken portion of FIG. 1) is an ink jet printhead 100, and specifically an ink supply manifold. An ink saturated medium, shown in accordance with one embodiment of the invention, has three separate portions marked 18. The ink saturated portions 18 occupy most of the chamber 13 of housing 12.

Figure 2:
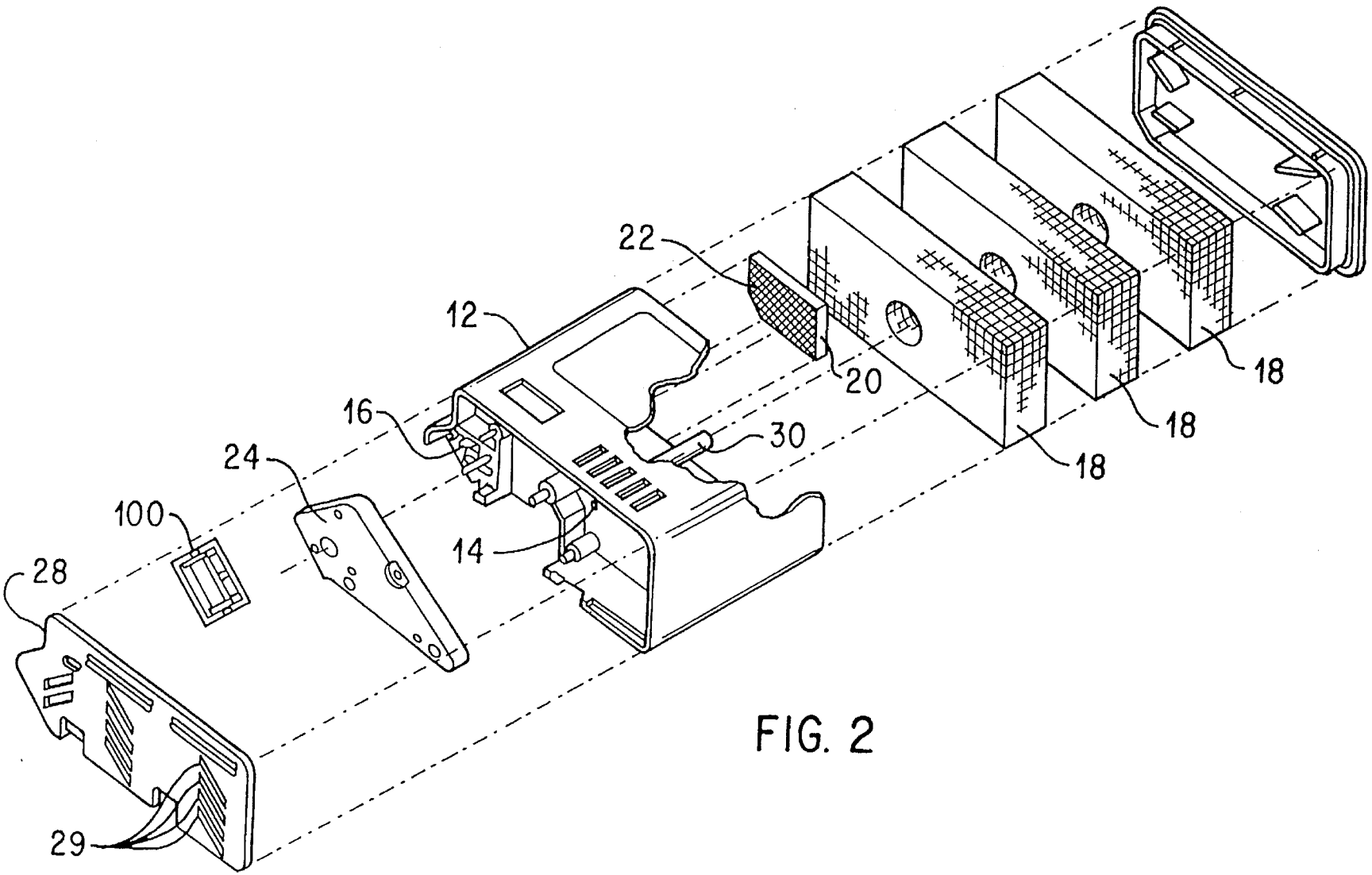
FIG. 2 is an exploded view of a cartridge as in FIG. 1*a* incorporating the present invention.

FIG. 2 is an exploded view of cartridge 10, showing how the various elements of a cartridge 10 may be formed into a compact customer-replaceable unit. Other parts of the cartridge 10, which are useful in one embodiment of the invention include a heat sink 24 and cover 28 having openings 29 to permit ventilation of the interior of housing 12 through ventilation port 14. A practical design will typically include space for on-board circuitry for selective activation of the heating elements in the printhead 100.

Also shown in FIGS. 1 and 2 is a tube 30 extending from ventilation port 14 (connected to an outside atmospheric pressure) toward a center of an interior of housing 12, through openings in each portion of ink storage medium 18 for pressure equalization.

For purposes of illustration, and in accordance with one embodiment of the invention, ink storage medium 18 (shown as three portions of material) is in the form of a needle felt of polyester fibers. Needled felt is made of fibers physically interlocked by the action, for example, of a needle loom, although the fibers may also be matted together by soaking or steam heating. In accordance with one embodiment of the invention, the needled felt has a density of between 0.06 and 0.13 grams per cubic centimeter. It has been found that the optimum density of this polyester needled felt ink storage medium 18 is 0.095 grams per cubic centimeter. This optimum density provides the most advantageous volume efficiency for holding liquid ink. The ink storage medium 18 is discussed in greater detail in U.S. application Ser. No. 07/885,704.

In summary, ink storage medium 18 is packed inside the enclosure of housing 12 in such a manner that the felt exerts reasonable contact and compression against the inner walls. In one embodiment of the invention, the ink storage medium 18 is created by stacking three layers of needled felt, each one-half inch in thickness, and packing them inside the housing 12.

Also within housing 12 is a member made of a material providing a high capillary pressure, indicated as scavenger 20. Scavenger 20 is a relatively small member which serves as a porous capillary linkage between ink storage medium 18 and the output port 16, which leads to the manifold of printhead 100. In a preferred embodiment of the invention, the scavenger 20 is made of a fine pore, fully open cell polyester polyurethane formulated with a proprietary additive. The raw material for the foam is available from Foamex of Eddystone, Pa., under the tradename "ULTRA FINE", and a felted version of the foam which is suitable for use in the scavenger is available through, for example, Illbruck USA, Minneapolis, Minn.

The improved material, ULTRA FINE, serves as an ink delivery and filtration medium for use in the scavenger 20. In particular, ULTRA FINE can be easily compressed to a specific density and absorbency. In accordance with the preferred embodiment of the invention, the ULTRA FINE is felted (compressed with heat and pressure) by 50% in the direction of intended ink flow. For example, in one embodiment, ULTRA FINE is cut into a 9 mm thick block. The block of ULTRA FINE is compressed with heat and pressure down to 4½ mm, which increases the density by 2. Due to the increase in density, the capillarity action can be improved and increased. Furthermore, once the ULTRA FINE has been compressed to the final desired density, no additional compression is needed once the scavenger has been positioned in the cartridge 10.

ULTRA FINE has a low compression set, which makes ULTRA FINE dimensionally stable. If compressed, ULTRA FINE resiliently springs back to its original position. For example, ULTRA FINE is sufficiently elastic to return to its original dimensions even when compressed for a long duration under, for example, pressure from the ink and ink storage medium 18. In particular, the ULTRA FINE scavenger can spring back to within 2 percent of its original dimensions. In addition, the ULTRA FINE scavenger does not substantially expand when ink is added.

The dimensional stability of the scavenger is particularly important in ink delivery systems because if there is a failure to sustain pressure between the filter and the ink well, an air leak may occur. An air leak occurs when lower resistant air is pulled into the scavenger instead of ink. It is difficult to recover and prime the printhead once air has entered the scavenger.

Because surfactants react with ink, foams that are created using surfactants must be cleaned with a freon wash to remove the surfactants prior to use. Because ULTRA FINE is formed by a foaming process substantially free of surfactants, there is no need for the expensive freon wash.

ULTRA FINE is also very clean. In a flow through test of ULTRA FINE, negligible particles were discharged. These negligible particles were no greater than 5 microns, which is too small to cause ink blockage. In addition, since the ULTRA FINE material is non-brittle and has a low modulus of elasticity, the ULTRA FINE scavenger does not break down and discharge particles or debris during use.

Furthermore, ULTRA FINE has good clickability or punchability (an ability of the cut edges to return to an original shape after being cut) due to ULTRA FINE's low compression set. When the edges of ULTRA FINE are cut to form the scavenger 20, the edges reliably bounce back to original dimensions.

FIG. 4 is a property comparison chart comparing an optimization target to scavengers using ULTRA FINE with an 11 micron filter and melamine foam with 11 and 9 micron filters. Properties such as ink compatibility, filtration, original cleanliness, punchability, compression set, expansion when wet, ink delivery, steady state impedance and chemical reactivity are compared for purposes of illustration. The ULTRA FINE scavenger with an 11 micron filter has a lower impedance than the melamine scavenger with an 11 micron filter. Furthermore, the ULTRA FINE scavenger has a substantially lower impedance than the melamine scavenger with a 9 micron filter. Although the melamine scavenger with an 11 micron filter is shown for purposes of illustration, such a filter is not practical in use because melamine foam is a dirty foam, and an 11 micron filter would not adequately filter out particles. For practical use the melamine scavenger needs a 9 micron filter.

The optimal filtration particle count when the scavenger is in use in the cartridge is zero fibers. As illustrated, ULTRA FINE has a detectable particle count of zero in the ink delivery system. Moreover, the incoming cleanliness of an ULTRA FINE foam, before being cleaned or vacuumed to remove particles, is superior to the incoming cleanliness of melamine. ULTRA FINE does not require cleaning to remove particles prior to use, whereas, with melamine it is a necessity.

The scavenger 20 preferably includes a filter cloth 22. The preferred material for the filter cloth 22 is monofilament polyester screening fabric as discussed in further detail in U.S. patent application Ser. No. 07/885,704. The filter cloth 22 can be laminated to ULTRA FINE without using a glue matrix. Accordingly, the cloth filter can be attached to ULTRA FINE in a single step. When ULTRA FINE is compressed to achieve a desired density, the filter cloth 22 can be laminated to the ULTRA FINE at the same time.

The high capillary force provided by filter cloth 22 creates a film of ink between the filter cloth 22 and the outlet port 16 by virtue of the planarity (no wrinkles or bumps) of the filter cloth 22 against the scavenger 20, the compression of the scavenger 20 against the outlet port 16, and the saturation of scavenger 20. This film serves to block out air from the outlet port 16.

In FIG. 1, it can be seen that one portion of the outer surface of the ink storage medium 18 abuts the scavenger 20, while other portions of the surface of the ink storage medium is exposed to open space 15 between the ink storage medium 18 and the inner walls of housing 12. The single chamber 13 is formed so that ink may flow to or from the ink storage medium 18, to or from the scavenger 20, or to or from the free space within the chamber 13; that is, there are no solid internal barriers to the flow of ink within chamber 13. This arrangement serves to maintain the back pressure of liquid ink within a manageable range while the cartridge is slowly emptied of liquid ink.

The ink transmittance through ink storage medium 18 is not rapid enough, however, to supply ink continuously to printhead 100 during high demand rates. In addition, felt of ink storage medium 18 does not provide the necessary seal to permit continuous, air-free flow of ink through outlet port 16. The scavenger 20 is intended to act as an ink capacitor that supplies a sufficient quantity of air free ink during high demand rates as will be explained in detail below.

In a typical commercial thermal ink jet printing apparatus, wherein the printhead is moved across a sheet in plural swaths, the time for printing an eight-inch swath is approximately 0.5 seconds. It takes approximately 0.1 seconds for the cartridge 10 to change direction between printing swaths. The scavenger 20 tends to desaturate during the printing of a swath as ink is placed on the sheet. The time between printing swaths is usually a "recovery" time, during which the scavenger 20 is allowed to resaturate, thereby returning to an equilibrium back pressure.

In accordance with one embodiment of the invention, the ink storage medium 18 is initially loaded with 68 cubic centimeters of liquid ink. It is desirable to obtain at least 53 cubic centimeters for printing purposes while the back pressure of the cartridge is within a useable range. A typical volume of the scavenger 20 is 2 cubic centimeters. In printing a typical eight-inch swath in the course of printing a document, the scavenger 20 may be desaturated by up to 2.5 percent of the ink therein in 0.5 seconds. This desaturation will cause an increase in back pressure at the printhead 100. This principle can best be envisioned by an analogy to a common sponge: it is easier to squeeze out a quantity of liquid from a saturated sponge than it is to squeeze out the same quantity of liquid from a desaturated sponge, even if the necessary amount of liquid is in the nearly dry sponge. As desaturation causes an increase in back pressure with any absorbent medium, back pressure will increase in the course of printing a single swath of significant density across a sheet.

However, although desaturation of scavenger 20 will cause an increase in back pressure at the printhead 100, this increased back pressure from the scavenger 20 works in the other direction as well. That is, desaturation of scavenger 20 will also cause a negative pressure against the ink storage medium 18, causing a quantity of liquid ink to move from the ink storage medium 18 to the scavenger 20, thereby resaturating scavenger 20 and lowering the back pressure thereof. The combination of ink storage medium 18 and scavenger 20 acts as a system for stabilizing the back pressure at the printhead 100 as the supply of ink in the ink storage medium 18 decreases.

Figure 5:
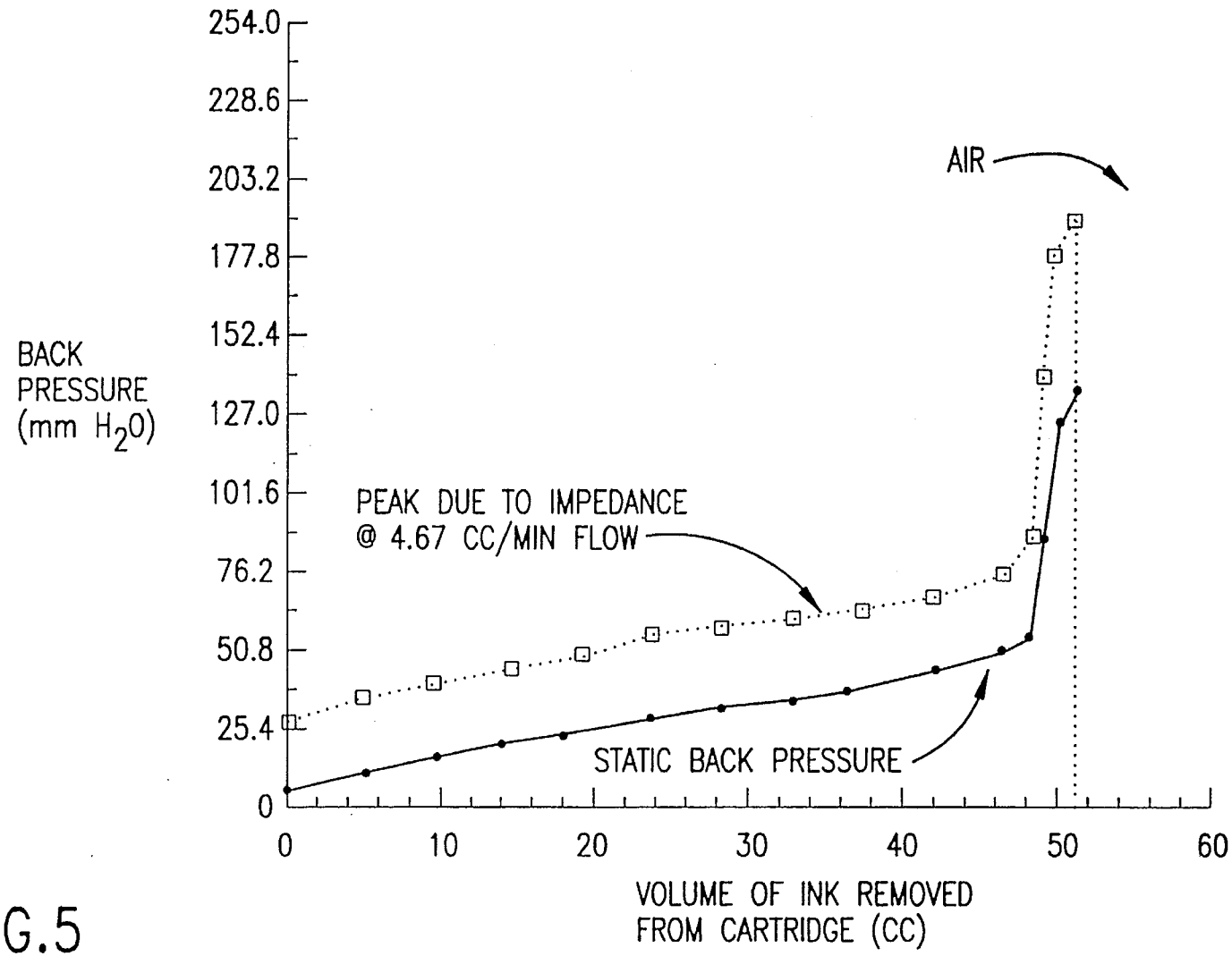
FIG. 5 is a graph of peristaltic ink delivery tests illustrating back pressure of liquid ink as a function of the amount of ink in the cartridge when the ink delivery and filtration medium in accordance with the invention is used.

FIGS. 5–8 are graphs of peristaltic ink delivery tests showing the performance of an ink jet cartridge 10. FIG. 5 shows the back pressure at the printhead of a cartridge having a scavenger made from the ULTRA FINE foam. FIG. 5 illustrates that the back pressure maintained at the printhead 100 is kept within a useable range for a great portion of ink levels in the cartridge 10. In FIG. 5, the X-axis represents the volume of ink delivered through the printhead 100 (i.e., as the cartridge empties out), while the Y-axis represents the back pressure at the printhead in millimeters of water, which is comparable to millimeters of liquid ink. The graph of FIG. 5 shows three lines; the solid line being the "static capillary pressure" of the cartridge at the printhead, the dotted line above the solid line represents momentary back pressures created in the course of printing out individual swaths across a sheet and a vertical line indicating the end of the ink supply when only air is being drawn from the cartridge, as in a typical context of printing documents such as the apparatus generally shown in FIG. 3. The back pressure is maintained at the best range, approximately 24 mm to 152 mm, up to the point where around 50 cc's of ink are delivered. In the preferred embodiment, the cartridge 10 is originally loaded with 68 cc's of ink, so only a small amount of ink is wasted because of insufficient back pressure.

Figure 6:
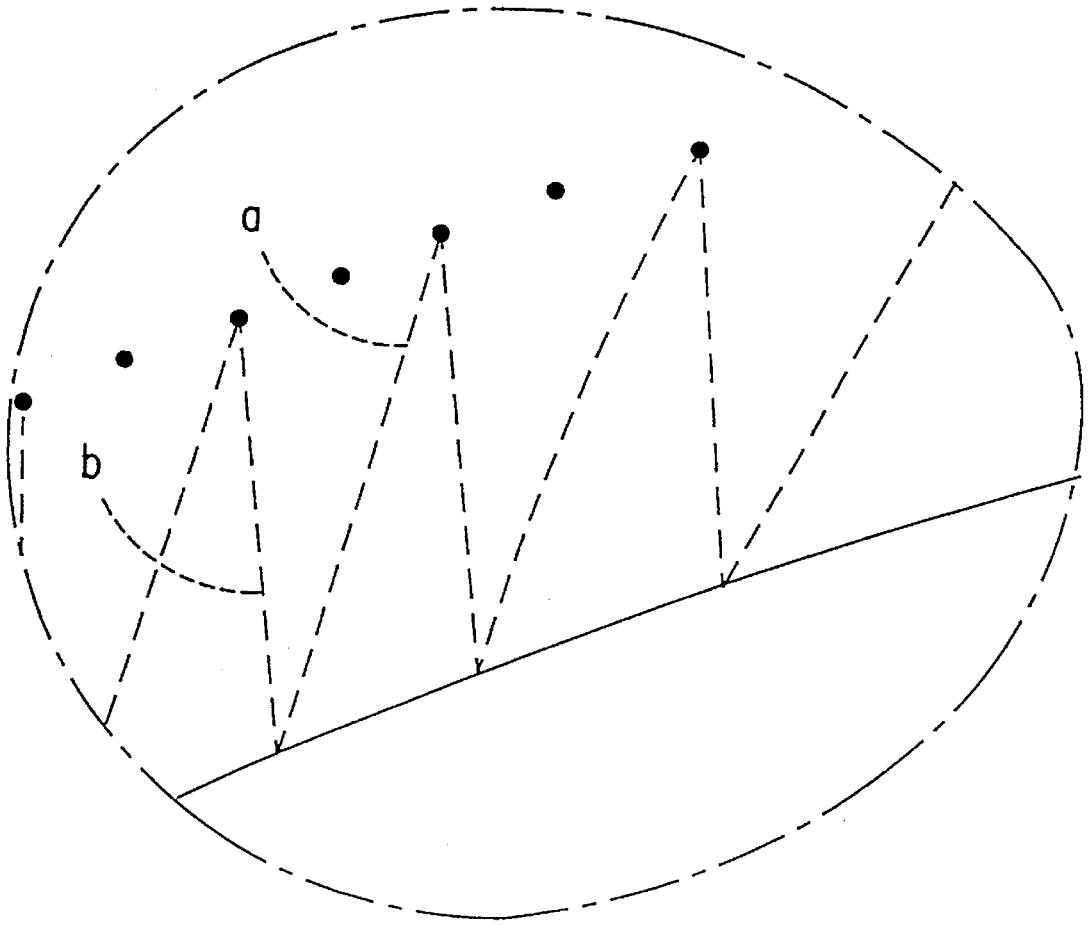
FIG. 6 is a detail of the graph of FIG. 3.

FIG. 6 is a detailed view of a portion of the graph of FIG. 5 showing the typical behavior of the back pressure in a cartridge 10 during continuous or substantially continuous use. In the type of thermal ink jet printing apparatus shown in FIG. 3, the cartridge 10 reciprocates across the copy sheet in a series of parallel swaths so that the printhead 100 may print out on an image on the copy sheet 210. Each swath across the copy sheet 210 typically lasts 0.5 seconds, while the turn around time at the end of each swath is approximately 0.1 seconds (in typical commercial embodiments the printhead 100 ejects ink onto the copy sheet when the cartridge 10 is moving in either direction). As mentioned above, liquid ink is drawn out of the cartridge 10 in the course of printing a swath, and the scavenger 20 substantially resaturates during the momentary changes of direction of the cartridge 10. When the scavenger 20 (and, by extension, the entire ink supply including ink storage medium 18) desaturates even slightly, the back pressure will increase. In substantially continuous use of the cartridge 10, the periodic desaturating and resaturating of the scavenger 10 translates into a cyclical pattern of increasing and decreasing back pressures, which can be seen in FIG. 6.

In FIG. 6, the finely-dotted lines, forming a sawtooth pattern with increasing portions a and decreasing portions b, show the actual continuous-time behavior of the back pressures between the solid line static capillary back pressure and the local maxima indicated generally by the larger dotted line visible in FIG. 5. With each sawtooth the momentary increases shown by portion a represent the increase in back pressure as the ink supply system gives up ink in the course of printing a swath; the relatively quicker down portions b of each sawtooth represent the relative rapid resaturation of the scavenger 20 in the turn around times.

In addition to the desaturation of the ink storage medium 18, another source of back pressure in a cartridge 10 is the "impedance" of ink flow through the various elements of the cartridge 10, caused by various sheer forces among the ink storage medium 18, scavenger 20 and other parts. There are also sheer forces at the microscopic level, for example, within the felt of ink storage medium 18 and the foam of scavenger 20.

Figure 7:
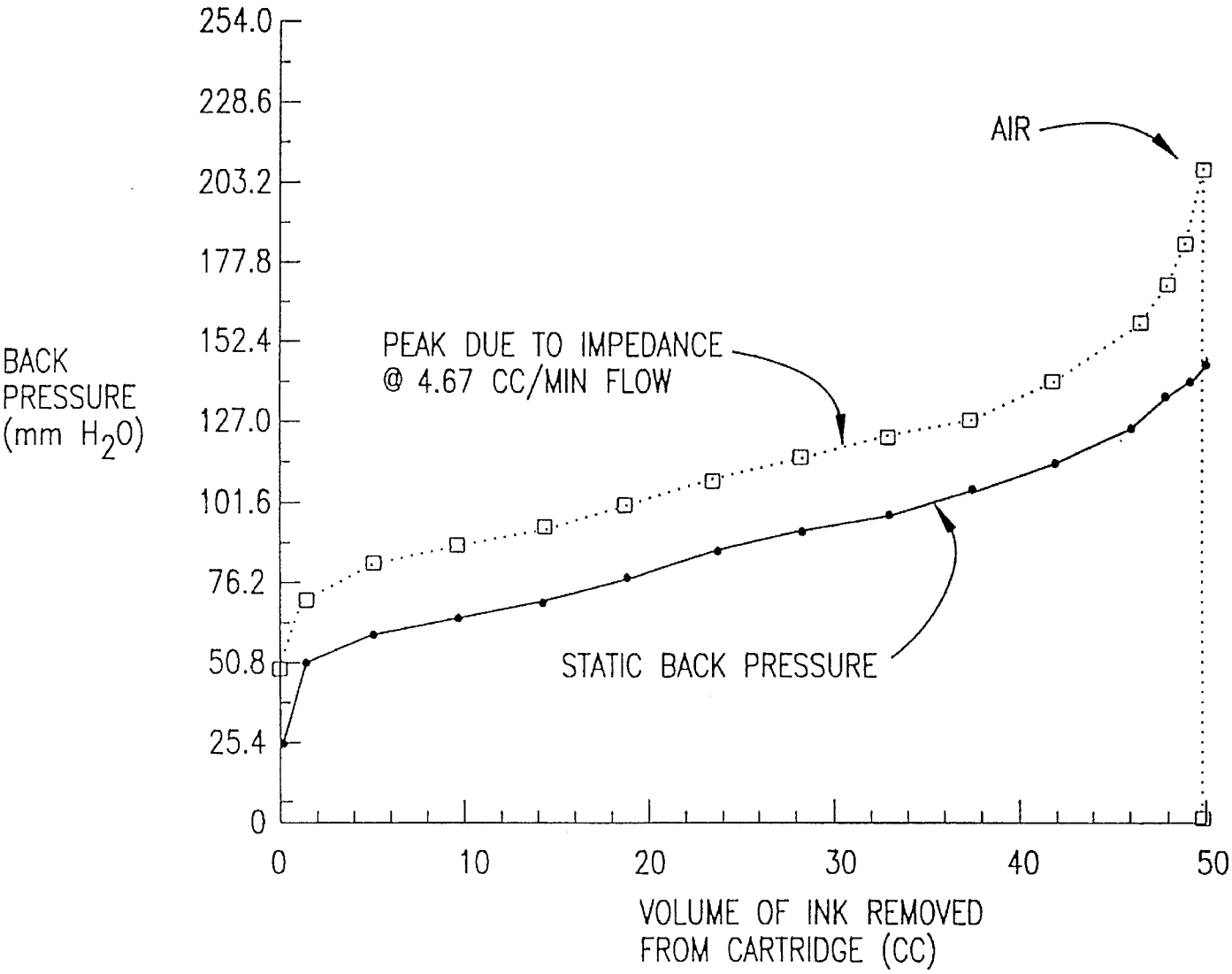
FIG. 7 is a graph similar to FIG. 5 illustrating back pressure for an ink cartridge using melamine foam with an 11 micron filter.
Figure 8:
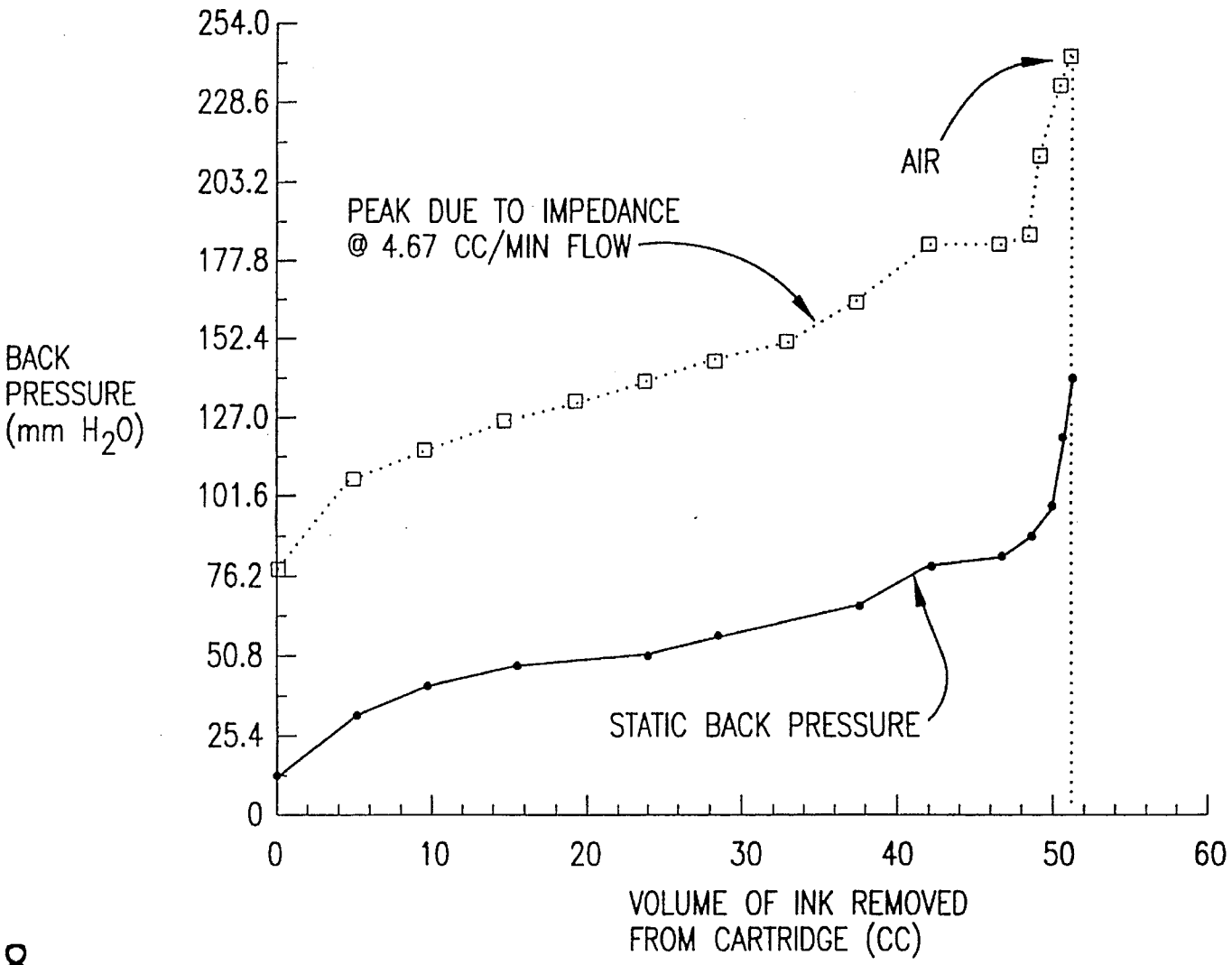
FIG. 8 is a graph similar to FIG. 5 illustrating back pressure for an ink cartridge using melamine foam with a 9 micron filter.

FIGS. 7 and 8 are graphs of peristaltic ink delivery tests similar to the graph of FIG. 5. FIG. 7 shows melamine foam with an 11 micron filter, and FIG. 8 shows melamine foam with a 9 micron filter. In comparing FIGS. 5 and 7 (both 11 micron filters), the cartridge having ULTRA FINE (FIG. 5 discussed above) reaches the outside of the best range, approximately 152 mm, (or end of the cartridge life) when 50 cc's of ink have been removed from the cartridge. In contrast, melamine foam (FIG. 7) reaches the outside sooner, in particular, after removal of 48 cc's of ink. Moreover, in the practical embodiment of melamine foam shown in FIG. 8 (having a 9 micron filter,) the outside of the range is reached after only 34 cc's of ink have been removed. Furthermore, as shown in FIG. 5, ULTRA FINE has a flatter line than the lines shown in FIGS. 7 and 8 for melamine. ULTRA FINE, since it has a flatter line, performs more stably throughout its life than the melamine foams. Accordingly, ULTRA FINE provides not only the desired range of back pressures at the printhead in a consistent manner over the life of the copy cartridge, but also maintains a relatively consistent amount of back pressure, even in the course of continuous use of the copy cartridge.

FIG. 9 shows test data from a test of the capabilities of ULTRA FINE in production cartridges designed to determine whether the ULTRA FINE changes the mean life of the cartridge (i.e., the number of pages printed). This test incorporated actual printing pauses, in contrast to the peristaltic pump tests in FIGS. 5–8. This test included a continuous run test producing approximately 1000 pages a day of a selected test image. Thirty-nine cartridges having ULTRA FINE with an 11 micron filter (as shown in FIG. 9, 20 pilot wait time parts and 19 production wait time parts) and 17 cartridges having melamine with a 9 micron filter were tested to life end. The ULTRA FINE and melamine foam were tested for practical use, therefore, as discussed above, the melamine cartridge used a 9 micron filter because an 11 micron filter is inadequate to filter particles and debris.

As seen under "Ink Weigh Loss", the ULTRA FINE cartridges output a mean of 61.06 grams of ink in contrast to the 59.40 grams of ink output by the melamine cartridges. The ULTRA FINE cartridges output approximately 1.66 grams more. As seen under "No. of Pages", the ULTRA FINE, cartridge printed a mean of 1261 pages, in contrast to the 1234 pages printed by the melamine foam cartridges.

While this invention has been described in conjunction with a specific apparatus, it is evident that many alternatives, modifications, and variations will be apparent to those skilled in the art. Accordingly, it is intended to embrace such alternatives, modifications, and variations as fall within the spirit and broad scope of the appended claims.

What is claimed is:

1. A system for supplying liquid ink to a thermal ink jet printing apparatus, comprising:

a housing defining a chamber having a ventilation port and an outlet port;

a liquid ink retaining medium occupying at least a portion of the chamber; and a scavenger member disposed across the outlet port, providing a capillary force greater than a capillary force provided by the medium, said scavenger member being substantially free of residual foaming surfactants and free of loose particles.

2. A system as in claim 1, wherein the scavenger member comprises a high density, fine pore fully open cell polyester polyurethane.

3. A system as in claim 1, further including a filter cloth attached to the scavenger member.

4. A system as in claim 3, wherein the filter cloth comprises monofilament polyester screening fabric.

5. A system as in claim 3, wherein the filter cloth is adhered to the scavenger member during a felting process.

6. A system as in claim 3, wherein the filter cloth comprises 11 micron pores.

7. A system as in claim 1, wherein the scavenger member comprises ULTRA FINE.

8. A system for supplying liquid ink to a thermal ink jet printing apparatus, comprising:

a housing defining a chamber having a ventilation port and an outlet port;

a liquid ink retaining medium occupying at least a portion of the chamber; and an ink delivery and filtration medium comprising a high density, fine pore fully open cell polyester polyurethane disposed across the outlet port.

9. A system as in claim 8, wherein the ink delivery and filtration medium is ULTRA FINE.

10. A system as in claim 8, wherein a filter is attached to the ink delivery and filtration medium.

11. A system as in claim 10, wherein the filter comprises 11 micron pores.

12. The system of claim 1, wherein the scavenger member is permanently densified by compression and is felted to a predetermined density and absorbancy by applying heat and pressure.

13. The system of claim 8, wherein the medium is permanently densified by compression and is felted to a predetermined density and absorbancy by applying heat and pressure.

14. The system of claim 8, wherein the ink delivery and filtration medium is free of surfactants.

* * * * *